United States Patent [19]

Kamezaki et al.

[11] 4,248,293

[45] Feb. 3, 1981

[54] APPARATUS FOR COOLING ENGINE OIL

[75] Inventors: Takashi Kamezaki, Tokyo; Yoshiaki Hidaka, Wako; Tetsuo Tahara, Kamifukuoka, all of Japan

[73] Assignee: Honda Giken Kogyo Kabushiki Kaisha, Shinbashi, Japan

[21] Appl. No.: 3,977

[22] Filed: Jan. 16, 1979

[51] Int. Cl.[3] ..... F01P 5/10

[52] U.S. Cl. ..... 165/51; 123/41.33; 123/196 AB; 417/244

[58] Field of Search ..... 123/41.33, 196 AB, 41.31; 165/51; 417/244, 251; 184/6.22, 104 B, 6.5

[56] References Cited

U.S. PATENT DOCUMENTS

| | | | |
|---|---|---|---|
| 3,255,590 | 6/1966 | Tipping et al. | 60/336 |
| 3,465,847 | 9/1969 | Donath et al. | 123/196 AB |
| 3,472,023 | 10/1969 | Gimmler | 60/345 |
| 4,118,142 | 10/1978 | Hahs | 417/244 X |

*Primary Examiner*—Albert W. Davis
*Assistant Examiner*—Margaret A. Focarino

[57] ABSTRACT

The present invention discloses an apparatus for cooling engine oil characterized in that there is provided an oil reservoir in communication with a first oil pump of an internal combustion engine. Further, an oil passage connects the pump to the oil reservoir, and the oil passage is provided with a by-pass passage in parallel with the oil passage. In the by-pass passage there is disposed an oil cooler on the upstream side and a second oil pump on the downstream side, the second pump also in communication with said oil reservoir.

7 Claims; 6 Drawing Figures

APPARATUS FOR COOLING ENGINE OIL

BACKGROUND OF THE INVENTION

The present invention relates to cooling means for internal combustion engines and, more particularly, relates to an apparatus in which an oil reservoir is supplied to various portions of an internal combustion engine through usage of an oil pump which employed for purposes of pressurized distribution of the oil throughout the respective portions of the internal combustion engine.

The prior art in the instant area has been characterized by such arrangements which are, schematically, illustrated in FIGS. 1 and 2.

In FIG. 1, representing a first example of the prior art, an oil cooler (d) is connected on the delivery side of an oil pump (b) which in turn is connected to an oil reservoir (a) which is positioned on the delivery side of an internal combustion engine (c). The arrangement of FIG. 1 is limiting in that the cooler (d) acts as a comparatively large load upon the pump (b). Consequently the pump B is required to deliver a comparatively large pressure with, resultingly, a loss in power to the overall system.

The second prior art arrangement, shown in FIG. 2, disposes the oil cooler (d) in parallel with the internal combustion engine (c) on the delivery side of the oil pump (b) which, in turn, is connected to an oil reservoir (a). This arrangement has been found to be inadequate in that the oil cooled by the cooler (d) is returned to the oil reservoir (a) without being used in the engine (c). Consequently a loss in efficiency is unavoidable.

Accordingly, the present invention may be viewed as a response to the shortcomings in the prior art as set forth in the examples of FIGS. 1 and 2 above.

SUMMARY OF THE INVENTION

The present invention constitutes an apparatus for cooling engine oil, including an oil reservoir in communication with an internal combustion engine, said engine having a drive shaft, said apparatus comprising: a first pump in delivery communication with said oil reservoir and in return communication with said engine; a second pump also disposed in delivery communication with said oil reservoir; and oil cooler medially disposed in series with respect to said first and second pumps, said cooler and said second pump exhibiting, in combination, a parallel relationship with respect to the series combination of said first pump and said engine; and spacer means mechanically disposed between said first and second pumps, said spacer means comprising a first chamber in communication with said oil reservoir and the input of said first pump; a second chamber in communication with said oil reservoir and the input to said second pump; a transverse port, said port providing communication between the output of said first pump and the input to said cooler; and a third chamber in communication with the output of said cooler and the input of said first pump, whereby, upon rotation of said drive shaft, rotor elements within each pump are actuated, thereby advancing the oil of the oil reservoir through a cooling circuit which includes the said parallel relationship between the said second pump and cooler with respect to the said first pump and engine.

It is an object of the present invention to provide an apparatus for cooling engine oil which will provide a maximum cooling capacity at a minimum consumption of energy, with reference to standards of such maximum and minimum heretofore established in the prior art.

Yet further objects of the present invention will become apparent from the hereinafter set forth Detailed Description of the Invention and the Drawings.

DETAILED DESCRIPTION OF THE INVENTION

Figure 3:
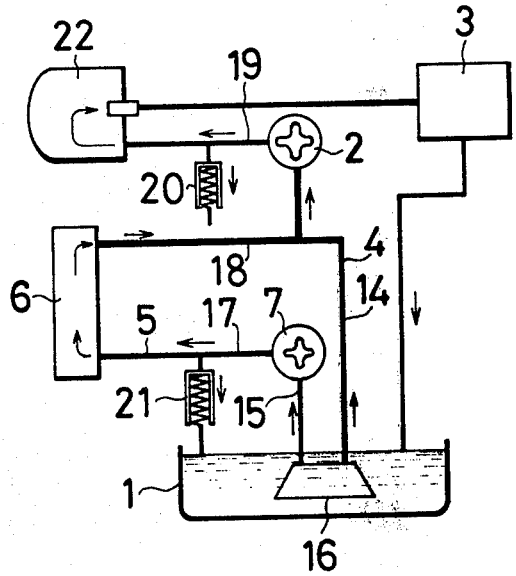
FIG. 3 is a schematic flow diagram of the present inventive concept.

With reference to FIG. 3, there is shown an oil reservoir 1 disposed in delivery communication with an oil pump 2 which in turn is in delivery communication with an internal combustion engine 3. The arrangement of FIG. 3 is characterized in that an oil passage 4, connecting the pump 2 to the oil reservoir 1, is provided with a by-pass passage 5 disposed in parallel with the oil passage 4 and, further, in that the by-pass passage 5 is connected to an oil cooler 6 on the upstream side, while an oil pump 7 is disposed on the downstream side with respect to said cooler 6.

In a preferred embodiment of the present invention, two oil pumps 2 and 7 respectively are constructed with their respective motors mounted upon a single common drive shaft 13, the same arranged to be rotated by a crank shaft of the engine 3; generally, the rotor within the oil pump 2 will be larger than the rotor within the oil pump 7.

Figure 1:
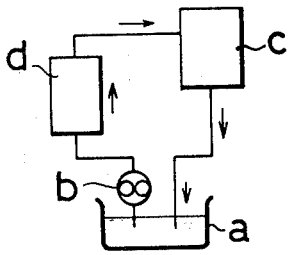
FIG.1 PRIOR ART
FIGS. 1 and 2 comprise flow diagrams of prior art cooling systems.
Figure 2:
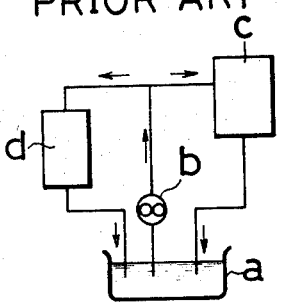
FIG.2 PRIOR ART

In operation, the oil in the oil reservoir 1 (which typically will comprise an oil pan) is introduced into the pump 2 through the parallel passages of the oil passage 4 and the by-pass passage 5 and, thereafter, the oil will be introduced into the engine 3 and then returned to the oil reservoir 1 through a return passage indicated by the arrow at the right hand side of FIG. 3. During such circulation of the oil, it is passed through, and cooled by, the oil cooler 6 which is disposed within the by-pass passage 5. Consequently, the oil, after a cooling by the cooler 6, is introduced into the engine 3. Accordingly, it is noted that the entirety of the oil cooled by the oil cooler 6 will be supplied to the pump 2 prior to return of the oil to the reservoir 1. This overcomes the problem in the prior art arrangement reflected in FIG. 2 in which the cooled oil is returned directly to the reservoir. It is to be further appreciated that, in the instant invention, the cooler 6 acts as a comparatively large load on the pump 7, however, due to the existence of the other pump 2 on the downstream side of the pump 7, said pump need possess comparatively little pumping capacity. Resultingly, the difficulties in the prior art arrangement of FIG. 1 are also alleviated.

It has been found that in construction of the present invention, the pumps 2 and 7 can be provided upon a single shaft such that the physical size of the oil circulation system can be minimized. In this regard, it has been found that the respective oil pumps 2 and 7, when disposed upon a single shaft, are preferably separated by an intermediate spacer 8, the whole thereof being secured together by means of bolts or the like, with rotors 11 and 12 of the respective pumps 2 and 7 located within the respective pump chambers 9 and 10.

The spacer 8 is provided with upper and lower flow passages 14 and 15 which are partitioned from one another (see FIG. 4); further, the respective pump chambers 9 and 10 are in communication, through said passages 14 and 15, with the exterior, that is, with the oil reservoir.

Figure 4:
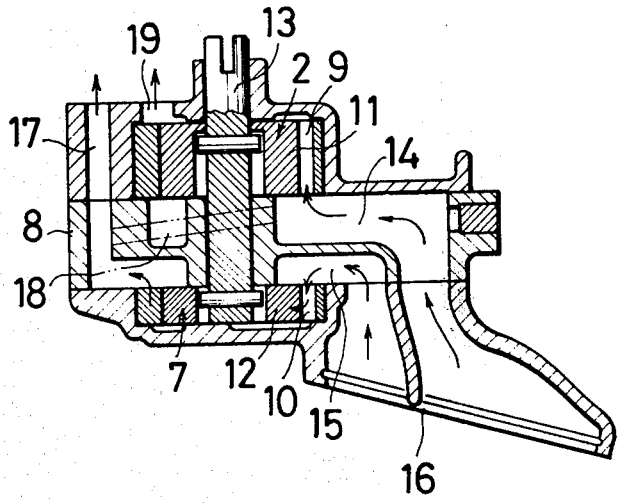
FIG. 4 is a longitudinal cross-sectional view of the present invention.
Figure 5:
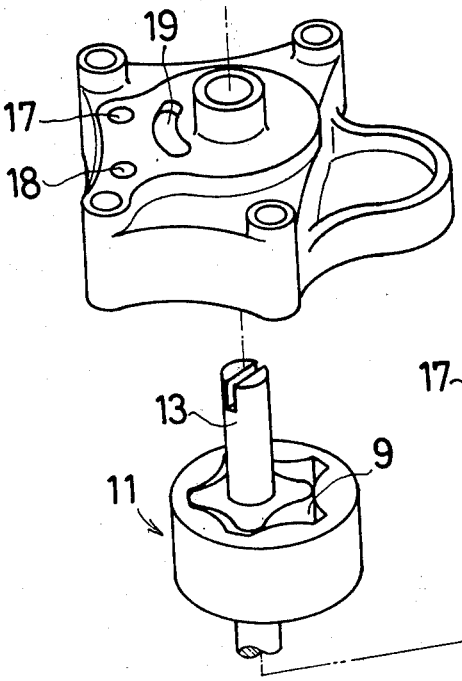
FIG. 5 is an exploded perspective view of the elements shown in FIG. 4.
Figure 6:
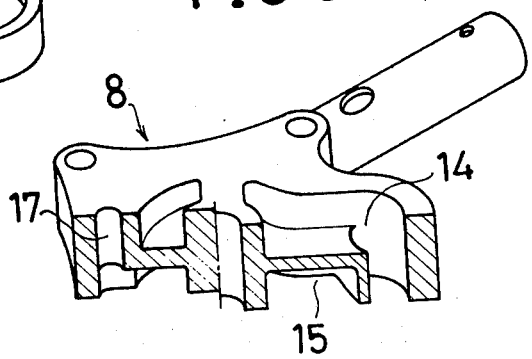
FIG. 6 is a sectional view taken along line 6—6 of FIG. 5.
Figure 6:
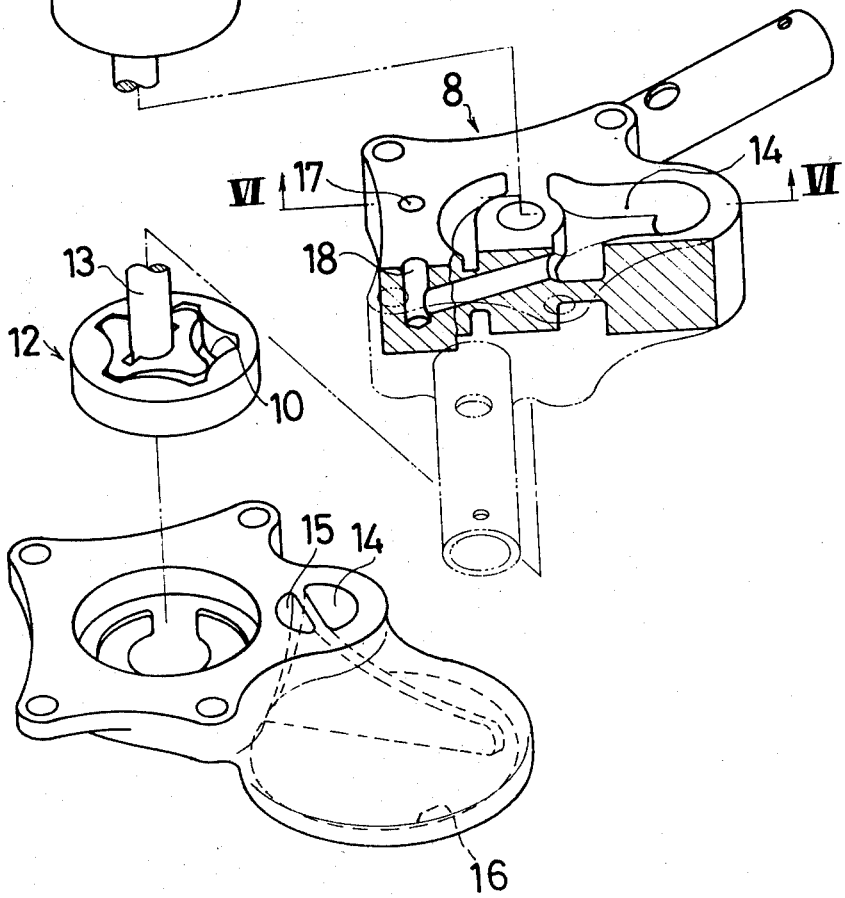

With particular reference to FIGS. 4, 5 and 6, the flow passage 15 is seen in communication (at the lower right side of FIG. 4) with an inlet opening 16 on the bottom side and is connected, at its end portion (at the left side of FIG. 4) with an outlet opening 17 on its top side, so that the resultant port forms an upstream side of the by-pass passage 5 completing a communication between the oil reservoir 1 and the oil cooler 6.

The flowing passage 14 is also in communication with the inlet opening 16 and, at its top end portion, with the pump chamber 9 so that the resultant port forms the flowing passage 4 connecting the oil reservoir 1 and the oil pump 2. In addition, the lower flow passage 14 is in communication with another inlet opening 18, occurring upwards through the spacer 8, so that the resultant port forms, on the downstream side, the by-pass passage 5 connecting the oil cooler 6 and the pump 2. As noted in the drawings, reference numeral 19 denotes an outlet opening made in the upper surface of the oil pump for connecting the interior of the pump 2 to the engine side 3.

With reference to FIG. 3, numerals 20 and 21 denote relief valves on the delivery side to the respective pumps 2 and 7, while the reference numeral 22 denotes a filter interposed between the pump 2 and the engine 3.

In mechanical operation, it is appreciated that the driving shaft 13 is provided with rotation by the engine or other prime mover, causing the respective rotors 11 and 12 to rotate in the respective pump chambers 9 and 10 so that the two pumps 2 and 7 are provided with simultaneous operation. Thereby, the engine oil in the oil pan 1 will flow through the circuit shown in FIG. 3 as, more particularly, indicated by the arrows therein.

Thusly, according to the present invention, the oil passage 18 on the inflow side of the oil pump 2 is provided with the by-pass passage 5, wherein the oil cooler 6 and the oil pump 7 are serially disposed within the by-pass passage 5.

Additionally, as above noted, the two oil pumps 2 and 7 are placed one upon another through the employment of the spacer 8, and are joined together by means of bolts or the like, so that the entirety of the apparatus can be made in a comparatively small size and, furthermore, the respective rotors 11 and 12 through respective pumps 2 and 7 can be provided upon the common driving shaft 13, thereby simplifying the driving mechanism of the rotors. Further, the respective flow passages 14 and 15 are formed in the spacer 8 so that there is no need for the separate installation of pipes or the like in order to accomplish fluid communication between the respective pumps 2 and 7.

Accordingly, it may be appreciated that the objects set forth in the Summary of the Invention have been efficiently obtained through the embodiment of the invention set forth above.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

We claim:

1. An apparatus for cooling engine oil including an oil reservoir in communication with an internal combustion engine, said engine including a drive shaft, said cooling apparatus comprising:

(a) a first pump in delivery communication with said oil reservoir and in return communication with said engine;

(b) a second pump also disposed in delivery communication with said oil reservoir;

(c) an oil cooler medially disposed in series with respect to both said first and second pumps, said cooler and said second pump exhibiting, in combination, a parallel relationship with respect to the series combination of said first pump and said engine; and (d) spacer means for facilitating oil flow between said reservoir, said first pump, said oil cooler, and said second pump, whereby, upon rotation of said drive shaft, rotor elements within each pump are actuated, thereby advancing the oil of the oil reservoir through a cooling circuit defined by the series-parallel relationship set forth above.

2. The apparatus for cooling engine oil as recited in claim 1 in which said spacer means comprises:

(a) a first chamber in return communication with said oil reservoir and in delivery communication with the input to said first pump;

(b) a second chamber also having return communication with said oil reservoir and having a delivery communication to the input of said second pump;

(c) a transverse port, said port providing a communication between the output of said first pump and the return side of said cooler; and (d) a third chamber in communication with the delivery side of said cooler and the input of said first pump, said spacer means being mechanically disposed between said first and second pumps.

3. The apparatus as recited in claim 2 in which said apparatus further comprises a filter interposed between said second pump and said engine.

4. The apparatus as recited in claim 2 in which said first and second pumps each further comprise relief valves.

5. The apparatus as recited in claim 2 in which the rotor elements within each pump exhibit a camming relationship with respect to the interior surface of said pumps, said camming relationship serving to create reciprocating increases and decreases of pressure within each pump thereby maintaining sufficient pressure within the cooling circuit.

6. The apparatus as recited in claim 2 in which the first pump, the spacer means, and the second pump are all radially disposed about said drive shaft.

7. The apparatus as recited in claim 6 in which each of said elements may be bolted together along the longitudinal axis defined by said drive shaft within a compact package which may be disposed proximate to the internal combustion engine.

* * * * *